United States Patent [19]

Pfrimmer

[11] Patent Number: 4,927,584

[45] Date of Patent: May 22, 1990

[54] METHOD OF CUSTOM MANUFACTURING SHOES AT A SPECIFIED HEEL HEIGHT

[76] Inventor: Donald R. Pfrimmer, 1550 Old Hickory Blvd., Brentwood, Tenn. 37027

[21] Appl. No.: 888,479

[22] Filed: Jul. 22, 1986

[51] Int. Cl.[5] ..... B29C 45/16

[52] U.S. Cl. ..... 264/154; 264/157; 264/223; 264/227; 264/249; 264/275; 425/2

[58] Field of Search ..... 264/154, 220, 222, 223, 264/226, 227, 163, 275, 279.1, 157, 249; 425/2; 156/212

[56] References Cited

U.S. PATENT DOCUMENTS

| | | | |
|---|---|---|---|
| 1,556,802 | 10/1925 | Page | 425/2 X |
| 1,661,425 | 3/1928 | Hess | 264/157 |
| 2,299,195 | 10/1942 | Ushakoff | 12/142 G |
| 2,447,512 | 8/1948 | Leahy | 156/244.11 |
| 2,547,419 | 4/1951 | Sugarman et al. | 264/152 |
| 2,622,347 | 12/1952 | Shaw et al. | 36/24.5 |
| 2,641,852 | 6/1953 | Leahy et al. | 36/24.5 |
| 2,856,633 | 10/1958 | Murray | 264/223 |
| 2,891,285 | 6/1959 | Kaplan | 264/223 |
| 2,894,288 | 7/1959 | Brindis | 264/223 |
| 2,907,067 | 10/1959 | Burger | 264/223 |
| 2,924,849 | 2/1960 | Buchman | 425/2 |
| 3,305,895 | 2/1967 | Ludwig | 264/255 |
| 3,436,781 | 4/1969 | Becka | 264/275 |
| 3,474,496 | 10/1969 | Klee | 264/255 |
| 3,608,004 | 9/1971 | Borisuck | 264/255 |
| 3,671,621 | 6/1972 | Fukuoka | 264/255 |
| 3,846,533 | 11/1974 | Carvier | 264/220 X |
| 3,983,204 | 9/1976 | Opinsky | 264/275 |
| 4,094,950 | 6/1978 | Oldham | 264/259 |
| 4,120,477 | 10/1978 | Justamante | 264/255 |
| 4,134,955 | 1/1979 | Hanrahan | 264/259 |
| 4,603,024 | 7/1986 | Denis | 425/2 X |

FOREIGN PATENT DOCUMENTS

| | | | |
|---|---|---|---|
| 1351199 | 4/1974 | United Kingdom | 264/255 |

*Primary Examiner*—Jay H. Woo
*Assistant Examiner*—Jeremiah F. Durkin, II
*Attorney, Agent, or Firm*—Luedeka, Hodges & Neely

[57] ABSTRACT

A method of custom manufacturing of shoes at a specified heel height is disclosed and includes forming a positive impression mold of the foot from a negative impression mold made with the foot oriented at the specified heel height. A sold impression form is provided having an upper surface shaped to correspond to the lower surface of the sole of a shoe with the specified heel height. The positive impression mold is located with its lower surface separated from the upper surface of the sole impression form by a distance approximating the desired sole thickness, after which a settable material adapted to harden to form a suitable sole is introduced into the space between the positive impression mold and the sole impression form. The sole impression form is then removed from the sole and the desired upper materials are attached to the sole to generally conform to the shape of the positive impression mold. A heel is then attached to the heel seat of the sole by injecting a settable material adapted to bond to the heel and the hole into a recessed area of the heel facing the lower surface of the sole.

6 Claims, 4 Drawing Sheets

METHOD OF CUSTOM MANUFACTURING SHOES AT A SPECIFIED HEEL HEIGHT

The present invention relates to shoe manufacturing and more specifically relates to a method of manufacturing shoes at a specified heel height.

It is known in the art of shoe manufacturing to custom design shoes or parts thereof to compensate for irregularities in foot structure or to make the shoes more comfortable. Most such methods involve making what is called a "last" of the foot which is a positive impression mold on which the sole and upper materials are formed. For example, U.S. Pat. No. 2,547,419 to Sugarman et al discloses a method of obtaining a foot impression by first forming a negative impression mold using plaster of Paris and then coating the negative impression mold with a barrier material on its inner surface to which is added more plaster of Paris to form the positive impression mold. Sugarman et al also shows the use of a granular shifting compressible material having a thin covering of a material adapted to set and form an impression of the lower part of the foot. U.S. Pat. No. 2,894,288 to Brindis discloses the use of an elastic form retaining mold in making the negative impression allowing easier removal of the foot from the impression material after it has set.

Other methods have been directed to taking casts of feet with the heel raised to simulate a dynamic position such as the method shown in U.S. Pat. No. 2,856,633 to Murray which discloses a method of forming a negative impression mold of a foot with the heel in a raised position. Other methods in this art have been directed to forming soles for correcting deformities in feet. Such a method is disclosed in U.S. Pat. No. 2,924,849 to Buchman which discloses a tray for being filled with a moldable material and inserted inside a shoe to form a foot-molded appliance.

There have also been developments in the area of heel attachment by which a bondable material such as plastic is injected into a hollowed portion of a heel communicating with a hollowed area in the heel seat of the sole of the shoe to attach the heel to the shoe.

Of the developments in this art, there is an absence of a simple, effective method for custom manufacturing of a sole at a designated heel height to which a heel having the desired height can be quickly and efficiently attached. The methods and apparatus of the prior art lack commercial viability for large scale custom manufacturing of shoes because of their failure to incorporate modern advances in materials and because of changes in style, especially regarding athletic shoes. Also, wearers tend to demand more comfort in shoes which is difficult to obtain since the advent of shoes with flexible plastic soles. Accordingly, there exists a need for a method of custom manufacturing shoes adaptable for use with modern materials being used in sole construction and which permits quick and efficient manufacturing of custom made shoes at specified heel heights to conform to the orientation of the foot at the designated heel height.

The present invention meets this need through the provision of a method of custom manufacturing shoes at a specified heel height by which a sole is made using modern materials to conform to the lower surface of the foot and to which is attached by injection of a bondable plastic material a heel having the specified heel height.

In accordance with a preferred form of the present invention, a method of manufacturing shoes at a specified heel height is disclosed. A negative impression mold of a foot for which a shoe is to be made is formed with the foot oriented at the specified heel height. The negative impression mold is then filled with a settable material adapted to set into a hard mass to form a positive impression mold of the foot. After the positive impression mold has hardened, it is removed from the negative impression mold. A sole impression form is provided having an upper surface shaped to correspond to the lower surface of the sole of a shoe with a specified heel height. The positive impression mold is then positioned with its lower surface separated from the upper surface of the sole impression form by a distance approximating the desired sole thickness. This separation is maintained to provide a space therebetween approximately equal to the dimensions of a sole with the desired thickness. A sole is then formed having the desired thickness by introducing into the space between the positive impression mold and the sole impression form a settable material adapted to harden to form a suitable sole. The sole impression form is removed from the sole and upper materials are attached to the sole to generally conform to the shape of the positive impression mold, after which a heel of the specified height is attached to the sole.

According to another aspect of the present invention, the negative impression mold is formed by constructing a foot support from a deformable material dimensioned and shaped so that when a foot is placed on a support, the vertical distance between the toes and the heel approximates the desired heel height. A foot is then placed on the foot support so that the support conforms to generally contact the lower surface of the foot. While the foot is on the support, a settable impression material adapted to set into a resiliently deformable mass is applied to the exposed surface of the foot. The resiliently deformable material facilitates easier removal of the positive impression mold from the negative impression mold.

According to a further aspect of the present invention, the positive impression mold, after being removed from the negative impression mold, is divided into an upper and a lower part. The lower part of the positive impression mold is attached to a top of a sole impression box so that when the top of the box is placed on the box, the lower surface of the lower part of the positive impression mold is separated from the sole impression form by a distance approximating the desired thickness of the sole. The space is then filled by pouring the sole-forming material in a liquid state into the space and permitting air displaced when the sole material is injected to escape through an opening in the box.

In accordance with an additional aspect of the present invention, the heel is formed with a central recessed area on the surface of the heel that is to be in contact with the sole. A conduit is formed in the heel for communicating with the recessed area when the heel is located in the desired position in contact with the sole. The heel is placed in the desired position in contact with the sole and a settable material is injected into the conduit to generally fill the recessed area, the adhesive material being adapted to bond to the sole material and heel material as it hardens to secure the heel to the sole.

In accordance with yet another aspect of the present invention, holes are formed extending into the heel from the recessed area, whereby the adhesive material, when injected into the recessed area through the conduit, fills the holes and hardens therein increasing the strength of the attachment of the heel to the sole.

The advantages and further aspects of the present invention will be readily appreciated by those of ordinary skill in the art as the same becomes better understood by reference to the following detailed description when considered in conjunction with the accompanied drawings in which:

BRIEF DESCRIPTION OF THE DRAWINGS

Referring now to the drawings in which like reference characters refer to like or similar parts throughout the several views, there are shown in FIGS. 1 through 12*b* various steps involved in manufacturing a shoe with a specified heel height.

FIGS. 1 through 4 generally illustrate the steps involved in forming a negative impression mold 10 from which there is formed a positive impression mold 12 that is essentially a carbon-copy of the foot. A sole 14 is shown in FIGS. 8*a* and 8*b* having been produced according to the steps illustrated in FIGS. 6 through 8. To prepare the sole 14, a sole impression form 16 is provided (see FIG. 6) having an upper surface 18 shaped to correspond to the lower surface of the sole of a shoe with the specified heel height. The sole impression form 16 is positioned adjacent the positive impression mold 12 with a lower surface 20 of the positive impression mold 12 separated from the upper surface 18 of the sole impression form 16 by a distance approximating the desired sole thickness. A preferred method of achieving the desired separation is shown in FIG. 6 and involves the use of a sole impression box 22 in which the sole impression form 16 and positive impression mold 12 are arranged in the manner shown. One suitable means for positioning the positive impression mold 12 in the sole impression box 22 is provided by dividing the positive impression mold 12 into an upper and a lower part, A and B, respectively, as shown in FIG. 5. The lower part B of the positive impression mold 12 is attached to the underside of a top 24 associated with the sole impression box 22 so that when the top 24 is placed on the box 22, a space 23 is maintained between the positive impression mold 12 and the sole impression form 16. A settable material adapted to harden to form a suitable sole is then introduced into the space 23 to form the sole 14. Depending on the configuration of the box 22, the sole 14 may have to be trimmed and shaped according to a procedure described below so that the peripheral edge of the sole 14 generally conforms to the periphery of the part of the foot to be in contact with the sole 14. Once the sole 14 is completed, the positive impression mold 12 is placed on the upper surface of the sole 14, the lower surface 20 of the positive impression mold 12 substantially mating with an upper surface 26 of the sole 14. Afterwards, upper materials are attached to the sole 14 to generally conform to the shape of the positive impression mold 12 in the manner shown in FIG. 10. Then, a heel 28 of the specified height is attached to the heel seat portion 30 of the sole 14. According to the steps broadly described above, a shoe is manufactured with a sole 14 having an upper surface 26 corresponding to the lower surface of the foot with the foot oriented at the specified heel height. It will be appreciated that the steps are easily accomplished using readily available materials, some of which will be discussed in detail below, and requires no great skill or experience to produce a shoe having the characteristics described.

Referring now to FIGS. 1 through 4, a preferred means for forming the negative impression mold 10 is illustrated involving first, the step of constructing a foot support 32 from a deformable material such as polyurethane or other like material having the characteristic of being deformable to conform to the lower surface of the foot or the planar section and remaining substantially deformed when the foot is removed from the surface of the material. As shown, the foot support 32 has a sloping upper surface 34 being higher at the rearward portion thereof than the forward portion by the approximate vertical distance between the toes and the heel of a shoe with a specified heel height. FIG. 3 illustrates application to the exposed dorsal surface of the foot a settable impression material adapted to set into a resiliently deformable mass which, after it has set, forms the negative impression mold 10. An exemplary material useful in formation of the negative impression mold 10 is the dental impression composition sold under the trademark JELTRATE. Preferably, the material selected should be of the cold-forming type to eliminate possible discomfort which can occur if the material releases heat as it sets or is in a hot melted state when applied. Also, it may be desirable to coat the surface of the foot with water before applying the material. Other suitable materials for coating the foot include; for example, silicon grease, petroleum jelly, or the like, with the material being adapted to form what is in effect a barrier between the foot and the impression material.

Figure 1:
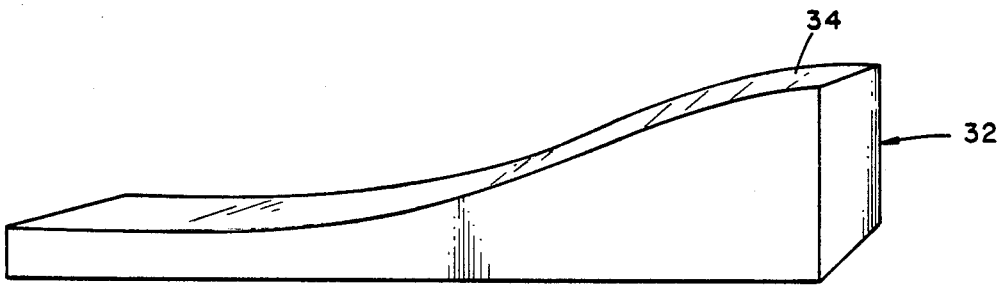
FIG. 1 is a perspective view of a deformable foot support for taking an impression of the lower surface of a foot.
Figure 2:
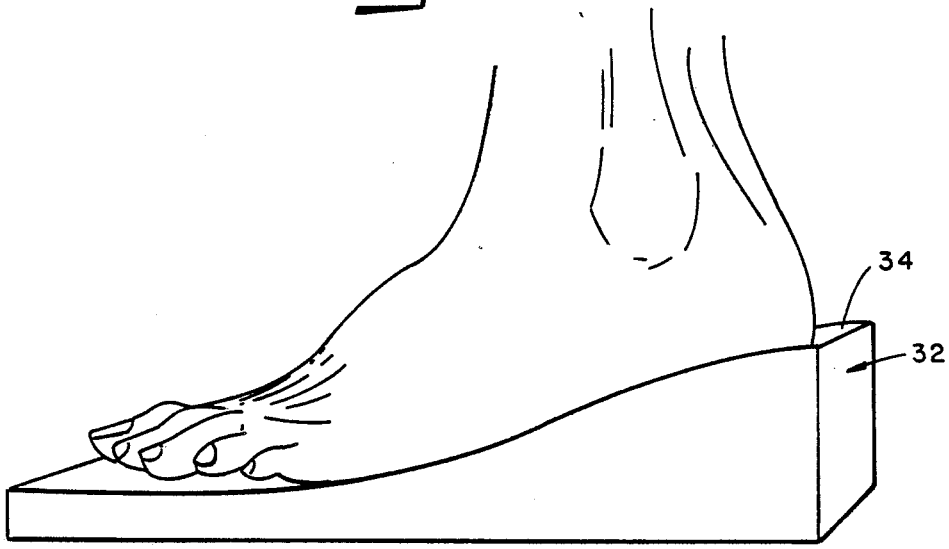
FIG. 2 is a perspective view of the foot support shown in FIG. 1, with a foot placed thereon to deform the upper surface of the foot support.
Figure 3:
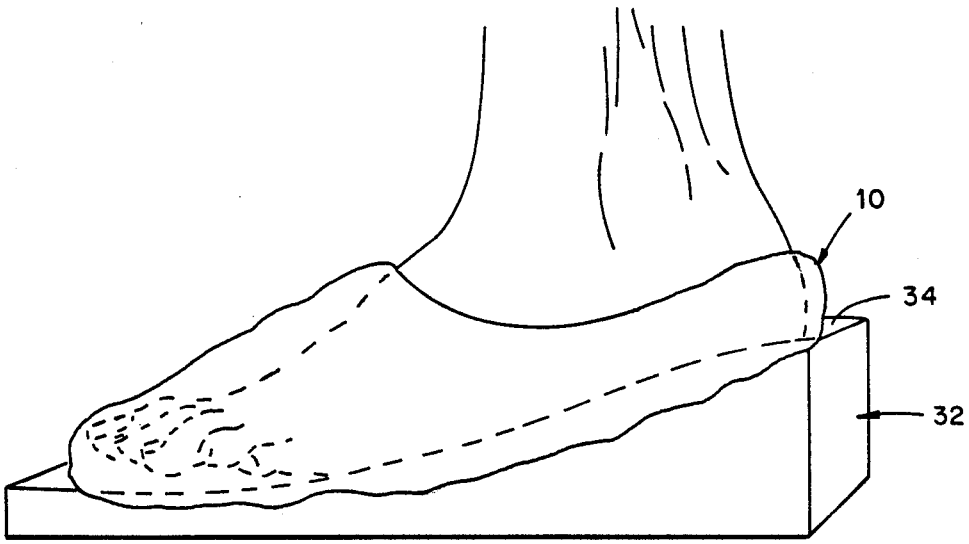
FIG. 3 illustrates application of a settable material to the area of the foot not in contact with the foot support to take an impression of the dorsal area of the foot.
Figure 4:
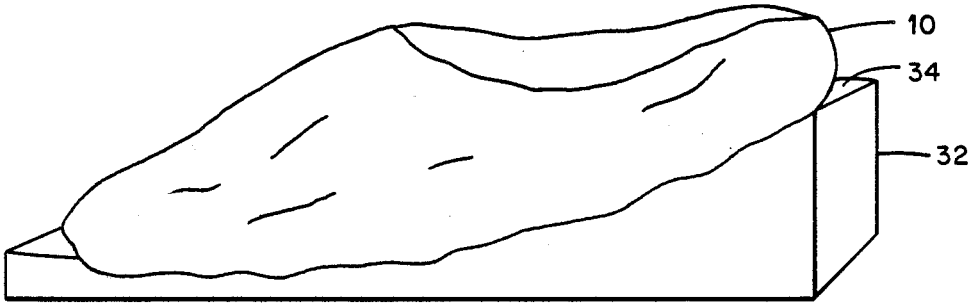
FIG. 4 is a perspective view illustrating a negative impression mold formed on the foot support with the foot having been removed from the mold.

In a preferred form of the present method, the settable impression material forming the negative impression mold 10 is extended, prior to setting, up on the dorsal surface of the foot at the front portion thereof to near the cuniform bones and at the rear of the foot to just above the calcaneus bone as shown in FIG. 3. This insures formation of a positive impression mold having surface characteristics corresponding to the area of the foot where straps and other types of upper material are likely to be positioned.

After the material has set, the foot can easily be removed from the negative impression mold 10 by flexing the muscles of the foot in the ankle area to deform the mold. The materials used to form the negative impression mold 10 and the foot support 32 are selected so that when the negative impression mold 10 is formed, it bonds to the upper surface 34 of the foot support 32 providing a unitary mold of the foot.

Once formed, the negative impression mold 10 is filled with a settable material adapted to set into a hard mass to form the positive impression mold 12. One suitable material for this purpose is the composition commonly referred to as plaster of Paris which is widely available and easy to use, but a preferable material is the product sold under the tradename HAPFLEX. After an appropriate period of time has elapsed for hardening of the plaster or for setting of the HAPFLEX, the positive impression mold 12 is removed for use in preparing the sole 14. Some trimming or shaping of the positive impression mold 12 may be necessary due to irregularities in the negative impression mold 10.

Figure 5:
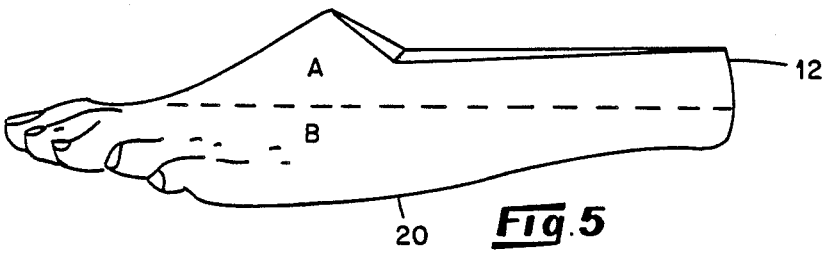
FIG. 5 is a side view of a positive impression mold formed by filling the negative impression mold shown in FIG. 4 with a settable material adapted to set into a hard mass.
Figure 6:
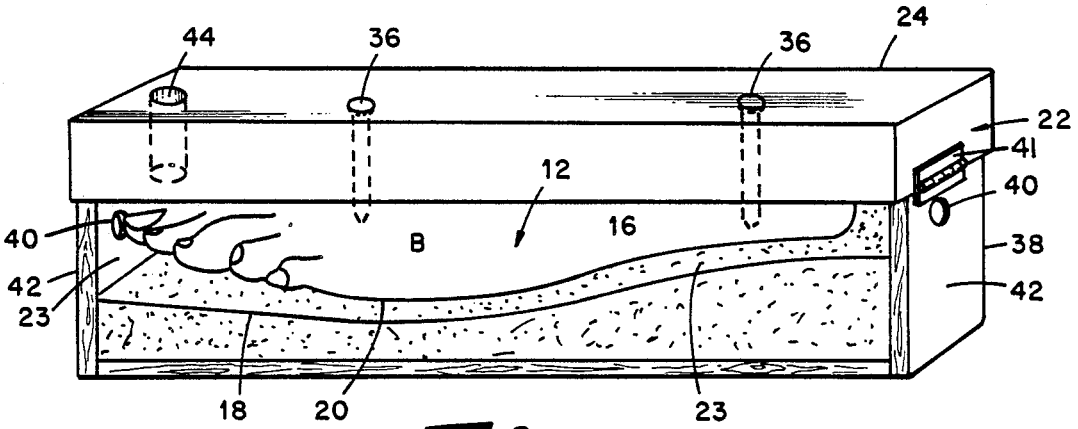
FIG. 6 is a perspective view of a sole impression box in which there is located a sole impression form in the bottom thereof separated from the lower surface of the bottom of the positive impression mold by a distance approximating the desired sole thickness.
Figure 7:
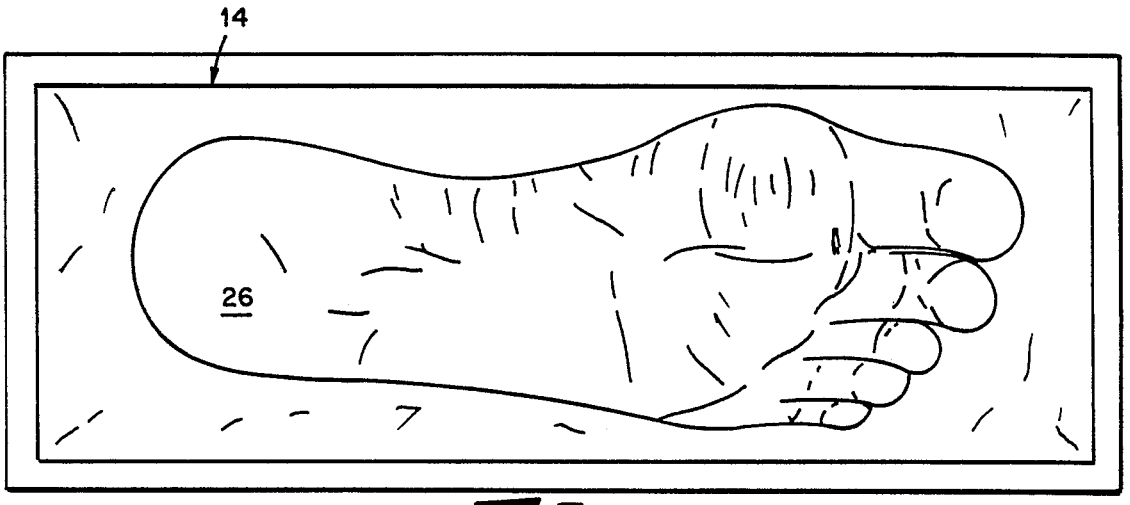
FIG. 7 is a plan view illustrating the upper surface of the rough form of a sole which has been formed in the sole impression box of FIG. 6.

FIGS. 5 through 8 represent one preferred form of constructing the sole 14 according to the method of the present invention. The positive impression mold 12 is divided as described above by effecting a generally horizontal cut in the mold 12 extending from the front of the mold 12 in the toe area at a height approximately equal to the height of the big toe, to the heel area of the mold 12 just below the middle of the heel. The lower part B of the positive impression mold 12 is then attached to the lower surface of the top 24 of the sole impression box 22, preferably by means of a pair of screws 36 centered longitudinally of the box 22 and spaced to provide balanced support for the lower part B of the positive impression mold 12. The top 24 of the box 22 and a containment portion 38 of the box 22 are dimensioned so that when the top 24 is placed on the box 22, the attached part of the positive impression mold 12 will be separated from the upper surface 18 of the sole impression form 16 by a distance approximating the desired thickness of the sole 14. Laterally, the box 22 is dimensioned to be no wider than is necessary to allow insertion in the containment portion 38 of the lower part B of the positive impression mold 12. This is realized when FIG. 7 is examined where it is seen that very little sole-forming material is permitted to set outside of the foot impression. Longitudinally, the box 22 is dimensioned to be slightly longer than the foot and has openings 40 located in its end walls 42 for permitting introduction of sole-forming material into the space 23 or for permitting escape of air displaced when the sole forming material enters the space 23. Also, holes can be formed in the top 24 of the box 22 such as the opening 44 which is shown in FIG. 6 in communication with the space 23. A hinge 41 may be used for connecting the top 24 to the containment portion 38 of the box 22 and a latch (not shown) may be used for securing the top 24 over the opening of the containment portion 38 preparatory to forming the sole 14.

Figure 8A:
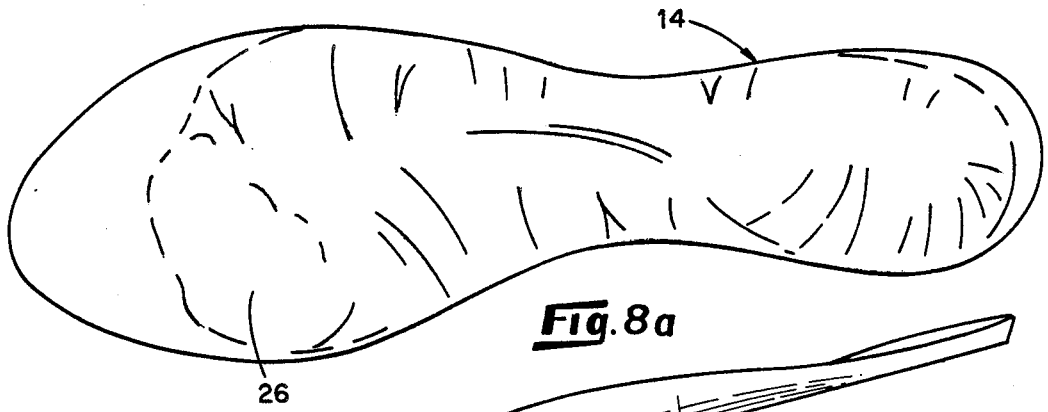
FIG. 8*a* is a top view of the sole shown in FIG. 7 with the edges and surfaces of the sole having been trimmed so that the sole has the desired shape.
Figure 8B:
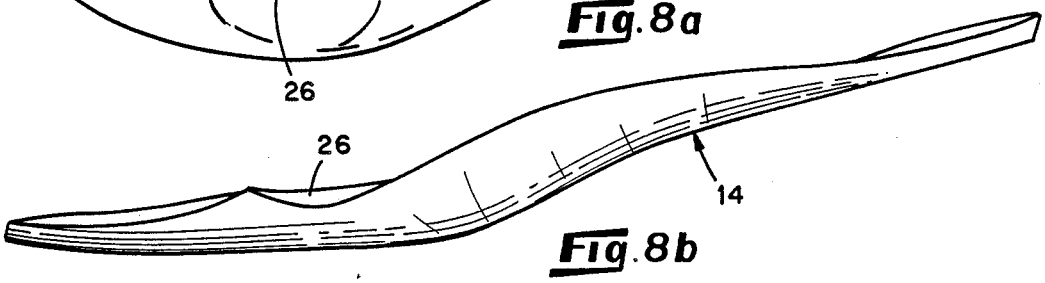
FIG. 8*b* is a side view of the sole as shown in FIG. 8*a;*

Once the top 24 is secured on the box 22, a settable material is introduced into the space 23 between the lower part B of the positive impression mold 12 and the upper surface 18 of the sole impression form 16. A suitable material for forming the sole 14 include polyurethane, or the like, as well as numerous others commonly employed in forming soles for shoes. Once the material hardens, the top 24 of the box 22 is removed and the rough form of the sole 14 as shown in FIG. 7 is lifted from the sole impression form 16. While not visible in FIG. 7, the lower surface of the rough sole 14 will generally be smooth, corresponding to the upper surface 18 of the sole impression form 16 and will require no further modifications prior to completion of the shoe. However, it will sometimes be necessary to trim or otherwise shape the rough sole form so that it corresponds to the silhouette of the foot as shown in FIG. 8*a*. This is easily accomplished by cutting away the outer material and trimming off part of the material remaining due to impression being taken of the area between the toes (compare the toe areas in FIG. 7 and FIG. 8*a*). Once trimmed, the sole 14 can be buffed around its edges so that it forms a smooth contour as shown in FIGS. 8*a* and 8*b*.

Figure 9:
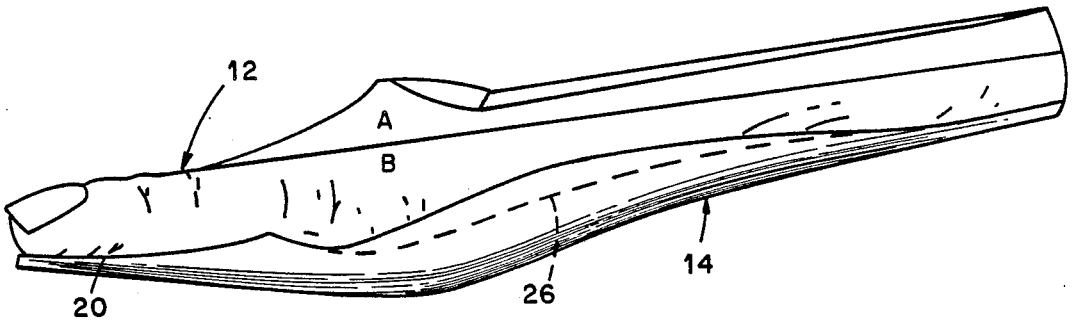
FIG. 9 is a side view showing placement of the positive impression mold on the upper surface of the sole formed according to FIGS. 6 through 8.
Figure 10:
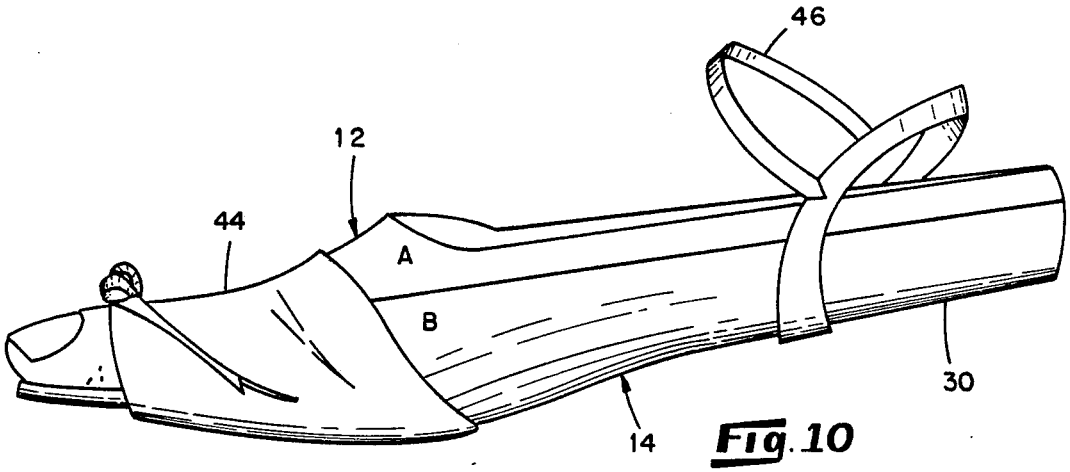
FIG. 10 is a side view of the sole and positive impression mold of FIG. 9 illustrating attachment of upper materials to the sole to generally conform to the shape of the positive impression mold.
Figure 11:
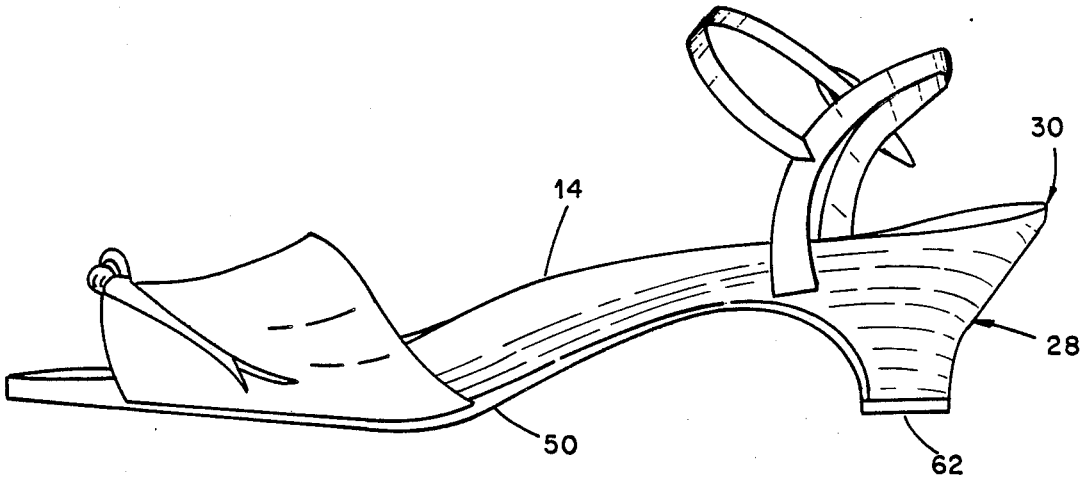
FIG. 11 is a side view of the finished shoe showing attachment at the heel seat portion thereof a heel having the desired heel height, the positive impression form having been removed.

The desired upper materials are applied generally according to the sequence illustrated in FIGS. 9 through 11 which first involves placement of the positive impression mold 12 on the sole 14. It is noted that the lower surface 20 of the positive impression mold 12 mates with the upper surface 26 of the sole 14 so that the positive impression mold 12 and sole 14 are in alignment. Upper materials 44 such as a leather or vinyl toe covering are then attached to the sole 14 as shown in FIG. 10. The upper material 44 generally is initially compliant, and is stretched over the positive impression mold 12 in a form retaining manner according to conventional shoe making methods so that when the positive impression mold 12 is removed, the upper material 44 retains its configuration. In a similar manner, a strap 46 or other type material is attached to the sole 14 just in front of the heel seat area 48 of the sole 14. Since a strap 46 is usually adjustable, it is generally not necessary that it be formed over a mold representing the size of the foot or ankle. After the upper materials 44 and strap 46 are attached, a sole undersurface 50 such as leather or rubber can be applied to the bottom surface of the sole 14 in a conventional manner.

Figure 12A:
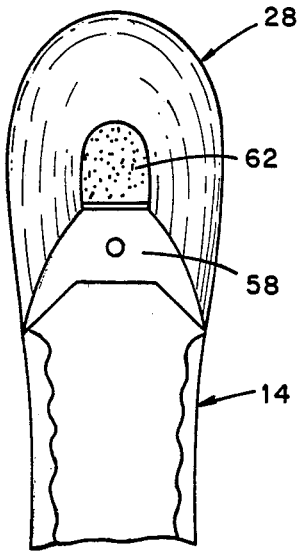
FIG. 12*a* is a sectional view as shown in FIG. 11 illustrating formation of a conduit in the breast portion of the heel.
Figure 12B:
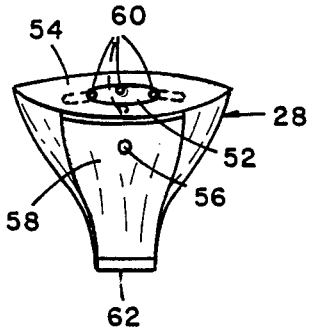
FIG. 12*b* is a view of the heel removed from the shoe illustrating a recessed area located in the center portion of the heel on the surface of the heel to be in contact with the sole showing formation of holes for receiving therein a settable material injected into the conduit which fills both the recessed area and the holes and bonds to the sole material and heel material to secure the heel to the sole.

A heel 28 of the desired shape and height is then provided for attachment to the heel seat area 30 of the sole 14. While the finished version of the shoe is shown in FIG. 11, FIGS. 12*a* and 12*b* illustrate aspects of a preferred method of attaching the heel 28 to the heel seat area 30. As shown in FIG. 12*b*, a central recessed area 52 is formed in a generally flat sloping surface 54 of the heel 28. A conduit 56 is formed preferably in the breast area 58 of the heel 28 for communicating with the recessed area 52 when the heel 28 is positioned with its upper surface 54 against the heel seat 50 of the sole 14. When the heel 28 is placed against the heel seat 48, a settable material such as polyurethane is injected into the conduit 56 to generally fill the recessed area 52. The settable material used is adapted to bond to the sole 14 material and heel 28 material as it sets to secure the heel 28 to the sole 14. The attachment of the heel 28 to the sole 14 is strengthened by forming a plurality of holes 60 extending into the heel material 28 from the recessed area 52 as shown in FIG. 12*b*. Preferably, the holes 60 are formed so that they extend generally horizontally out from the recessed area 52 to lockably attach the heel 28 to the sole 14 when the settable material hardens in the holes 60. Also, stability of the attachment of the heel 28 to the sole 14 is improved by having the holes 60 equally spaced around the recessed area 52.

As shown in FIG. 11, the sole undersurface 50 extends from the tip of the sole 14 back to the top of the breast area 58 of the heel 28, and can be extended to cover the breast area 58 so that the conduit 56 is not visible after the construction of the shoe is completed.

It will be appreciated that the various components comprising the finished shoe can be constructed of ordinary materials commonly used in shoe manufacturing. For example, the heel 28 can be formed using a plastic molding process, having an exposed plastic outer surface simulated to resemble wood or leather, or the heel 28 can be constructed of wood as are many such heels, or the heel 28 can be formed of plastic with a leather covering as is the practice in some styles. Once attached, the heel 28 is finished by having a rubber pad 62 (top lift) attached to its bottom for being in contact with the walking surface to prevent wearing of the bottom of the heel 28, and for providing slip resistance.

Referring to FIGS. 5 and 7, it should be appreciated that use of the sole impression box 22 represents one preferred method of forming the sole 14 from the positive impression mold 12. Another method of forming the sole 14 using the positive impression mold 12 and the sole impression form 16 includes locating performed plastic spacers (not shown) on the surface of the sole impression form 16 and then clamping the positive impression mold 12 on the plastic spacers, the spacers being dimensioned to approximate the desired sole thickness. Then, the sole forming material would be spatulated or otherwise introduced in the space 23 between the positive impression mold 12 and the sole impression form 16, the plastic spacers being adapted to bond to the sole forming material as it hardens so that after the material has been hardened to form the sole 14, the spacers become part of the sole 14. It is noted that in this manner, excess material around the perimeter of the positive impression mold 12 can be controlled to minimize or eliminate trimming and shaping of the sole 14 after it hardens.

It should also be noted that in the various mold forming processes, including the formation of the sole 14, it may be necessary to coat the surfaces of the various molds, etc., with a barrier material such as, for example, sodium silicate, silicon lubricant spray, or some of the well known petroleum products to prevent the material from bonding to the mold. For example, it has long been the practice in forming plaster of Paris impressions to coat the surface of the mold from which the impression is to be made with a solution of sodium silicate. With the use of plastics, certain petroleum and silicon compounds have been found to be useful for this purpose and should be employed in the steps of forming the sole 14 as described to prevent undesirable bonding from occurring.

Although particular embodiments have been described in the foregoing detailed description of the invention, it will be understood that the method practiced according to the invention is capable of numerous rearrangements, modifications, and substitutions of parts or steps without departing from the scope of the invention as set forth in the claims below.

What is claimed is:

1. A method of custom manufacturing shoes at a specified heel height with a predetermined sole thickness, comprising:

forming a negative impression mold of a foot for which a shoe is to be made with the foot oriented at the specified heel height;

filling the negative impression mold with a settable material adapted to set into a hard mass to form a positive impression mold of the foot;

removing the positive impression mold from the negative impression mold after the positive impression mold hardens;

dividing the positive impression mold into an upper and lower part;

providing a sole impression box having a bottom, sides, an open top, and a removable cover for being placed on the open top, said cover having an underside;

providing a sole impression form having an upper surface shaped to correspond to the lower surface of a sole of a shoe with the specified heel height;

placing the sole impression form in the box on the bottom thereof so that the upper surface of the form faces the open top of the box;

atttaching the lower part of the positive impression mold to the underside of the cover of the sole impression box so that when the cover of the box is placed on the open top of the box, the lower surface of the lower part of the positive impression mold is separated from the upper surface of the sole impression form by a space such that the distance of separation between the positive impression mold and the sole impression form is approximately equal to the desired sole thickness;

placing the cover on the open top of the box;

introducing a settable material adapted to harden to form a suitable sole into the space through an opening in the box;

permitting air displaced when the settable material is introduced into the space to escape through a second opening in the box so that the settable material substantially fills the space between the positive impression mold and the sole impression form;

permitting the settable material that was introduced between the positive impression mold and the sole impression form to harden to form a sole;

separating the sole from the positive impression mold and the sole impression form;

attaching upper materials to the sole; and attaching a heel of the specified heel height to the sole.

2. A method of custom manufacturing shoes at a specified heel height, comprising:

forming a resiliently deformable negative impression mold of a foot for which the shoe is to be made with the foot oriented at the specified heel height;

filling the negative impression mold with a settable material adapted to set into a hard mass to form a positive impression mold of the foot;

deforming the negative impression mold and removing the positive impression mold after the positive impression mold hardens;

providing a sole impression mold having an upper surface shaped to correspond to the lower surface of the sole of a shoe with the specified heel height;

positioning the sole impression form adjacent the positive impression mold with the lower surface of the positive impression mold separated from the upper surface of the sole impression mold by a distance approximating the desired sole thickness;

introducing between the positive impression mold and the sole impression form a settable material adapted to harden to form a suitable sole so that when the settable material hardens, a sole is formed having the desired sole thickness;

permitting the settable material to harden to form the sole;

removing the sole impression form from the sole;

attaching upper materials to the sole to generally conform to the shape of the positive impression mold;

providing a heel having the selected heel height;

forming a central recessed area on the surface of the heel that is to be in contact with the sole;

forming a conduit in the heel for communicating with the recessed area when the heel is located in the desired position in contact with the sole;

placing the heel in a desired position in contact with the sole; and injecting a settable material into the conduit to generally fill the recessed area, the settable material being adapted to bond to the sole material and heel material as it sets to secure the heel to the sole.

3. The method of claim 2, wherein the step of forming the negative impression mold comprises:

constructing a foot support from a deformable material so that when a foot is placed on the support, the vertical distance between the toes and the heel approximates the desired heel height;

placing a foot on the foot support so that the support deforms to generally contact the lower surface of the foot;

applying to the exposed surface of the foot a settable impression material adapted to set into a resiliently deformable mass; and providing sufficient time to allow the impression material to set.

4. The method of claim 2, further comprising the step of forming holes extending into the heel from the recessed area, whereby the settable material, when injected into the recessed area through the conduit, fills the holes and hardens therein, increasing the strength of the attachment of the heel to the sole.

5. The method of claim 4, wherein the step of forming holes further comprises forming the holes so that they extend generally horizontally from the recessed area to lockably attach the heel to the sole.

6. The method of claim 5, wherein the holes are generally equally spaced, one from another, to improve the stability of the attachment of the heel to the sole.

* * * * *